United States Patent [19]

Postell, Jr.

[11] 4,147,491

[45] Apr. 3, 1979

[54] APPARATUS FOR FORMING SIMULATED OLD BRICK

[75] Inventor: James M. Postell, Jr., Columbia, S.C.

[73] Assignee: Richtex Corporation, Columbia, S.C.

[21] Appl. No.: 873,071

[22] Filed: Jan. 27, 1978

[51] Int. Cl.[2] ..... B28B 11/08

[52] U.S. Cl. ..... 425/385; 425/297; 425/304; 425/305.1

[58] Field of Search ..... 425/304, 385, 297, 305; 264/284, 293

[56] References Cited

U.S. PATENT DOCUMENTS

| | | | |
|---|---|---|---|
| 275,888 | 4/1883 | Coutant | 425/385 |
| 402,962 | 5/1889 | Morgan et al. | 425/385 |
| 519,773 | 5/1894 | Pride | 425/385 |
| 1,101,093 | 6/1914 | Reagan | 264/293 |
| 1,283,770 | 11/1918 | Hoiles | 425/385 |
| 1,417,788 | 5/1922 | Wilson | 264/210 |
| 1,559,948 | 11/1925 | Farris | 264/284 |
| 1,773,857 | 8/1930 | Porter | 425/385 |
| 2,588,595 | 3/1952 | Warner | 425/385 |
| 3,728,062 | 4/1973 | Layman | 425/385 |
| 3,754,850 | 8/1973 | Pate | 425/385 |

*Primary Examiner*—Roy Lake
*Assistant Examiner*—John McQuade

[57] ABSTRACT

Disclosed are apparatus for forming rounded and textured edges along lengthwise extending faces of new brick to simulate old brick. The apparatus includes an elongated support having a transversely extending conveyor adjacent one end for receiving brick slugs. The slugs are successively pushed onto the support and through a cutter to form bricks. First and second transverse rows of inclined ramps are spaced longitudinally one from the other along the support with adjacent ramps in each transverse row spaced one from the other a distance in excess of the width of a brick. The ramps of the first and second rows are transversely offset one from the other a full brick width. When a transverse row of bricks is displaced longitudinally along the support through the first row of ramps, alternate bricks are elevated and inclined by the ramps into engagement with a first set of weighted rollers. The rollers impress the desired rounded and textured configuration into and along the opposite edges of the lengthwise extending faces of the elevated alternate bricks whereupon the elevated bricks return to the support flush with the unedged and unelevated bricks. When the row of brick is displaced through the second row of ramps, the alternate unedged bricks are elevated and inclined into engagement with a second set of weighted rollers which similarly round and texture the opposite edges of the lengthwise extending faces of the previously unedged bricks.

23 Claims, 16 Drawing Figures

FIG. 4
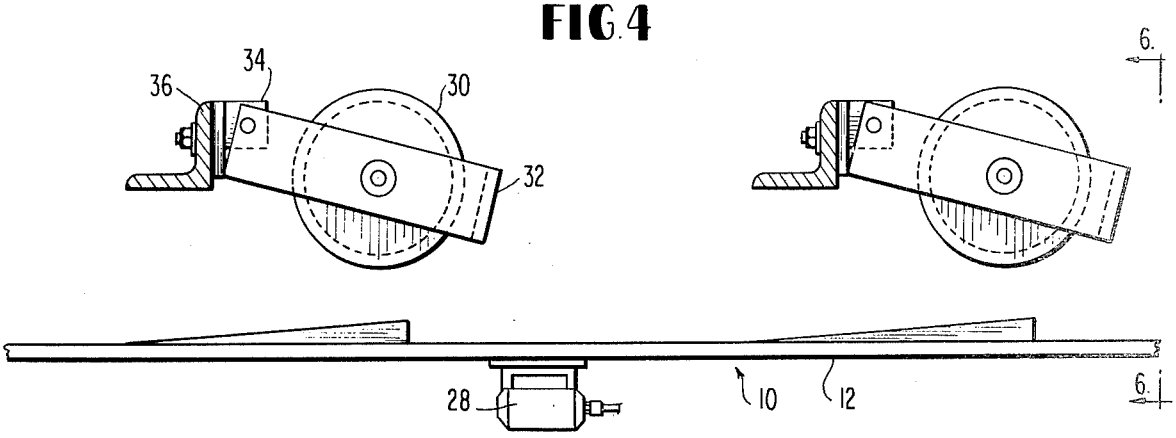
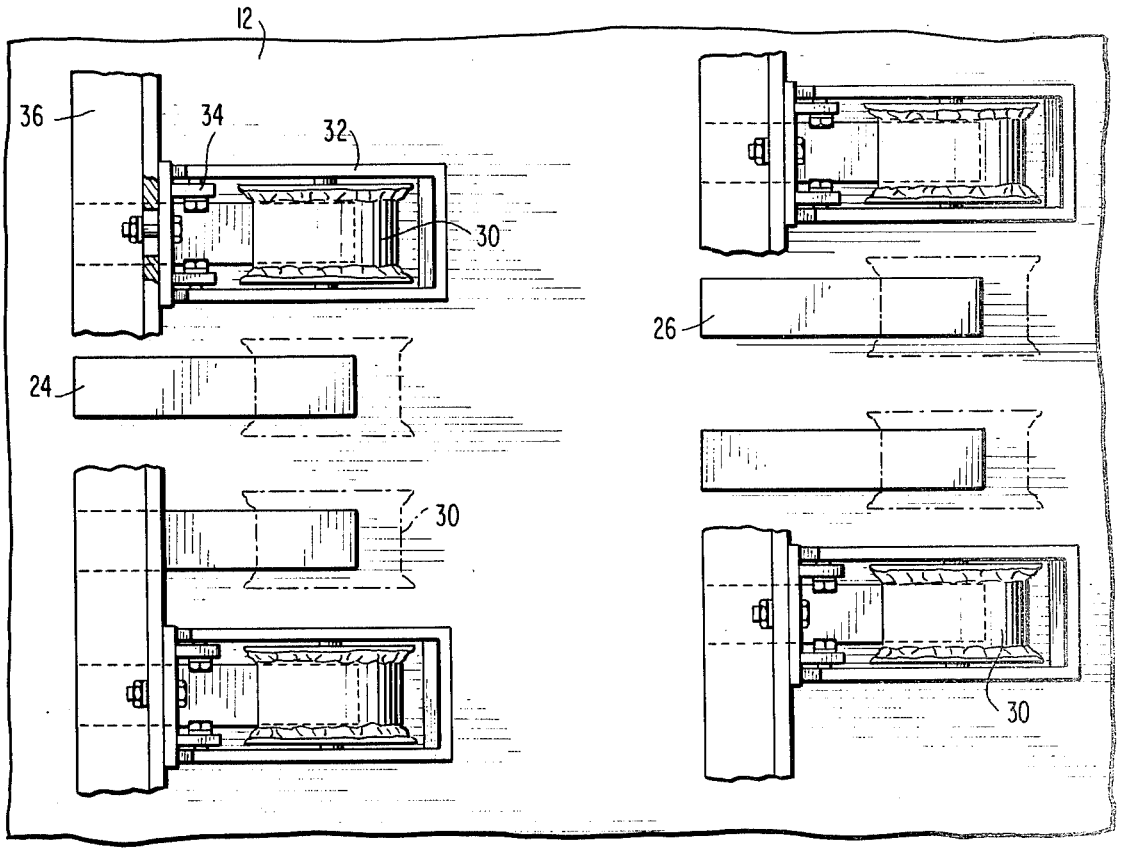
FIG. 5
FIG. 6
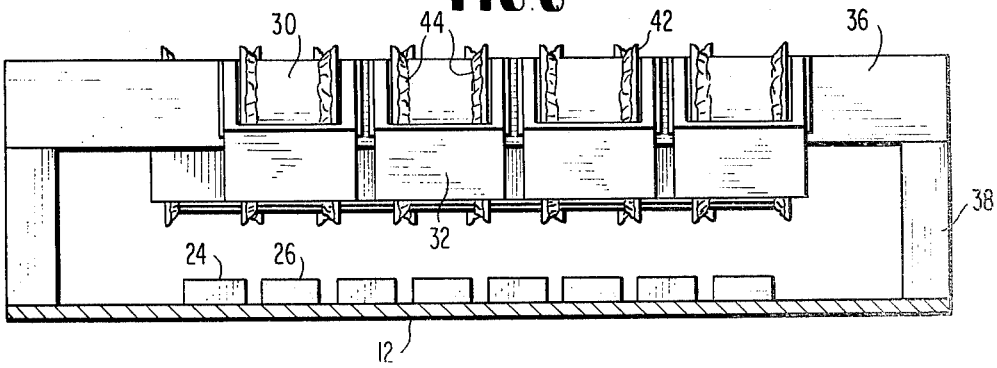

18
20
22
14
12
24
26
30
32
36
S1
S2
S3
S4
S5
S6
S7
B1
B2

APPARATUS FOR FORMING SIMULATED OLD BRICK

The present invention relates to apparatus for forming simulated old brick and particularly relates to apparatus for forming rounded and textured edges along a lengthwise face of each brick to simulate old brick.

As used herein, the term "simulated old brick" means a brick having an impression formed mechanically along at least one face to provide an appearance of used brick, i.e., brick which has been used in building construction in the past and been exposed to various environmental conditions over a long period of time. Synonomous with the term "simulated old brick" are terms of art such as "antique brick"; "new used brick"; "new old brick"; "reclaimed brick"; and "simulated used brick".

Increasingly, the construction industry has been faced with a demand for simulated old brick which far exceeds the quantity of brick which can be reclaimed from old buildings or homes. In order to meet this demand, producers of brick have devised apparatus and methods for forming new brick to give the appearance of old or used brick. For example, U.S. Pat. No. 3,754,850 to Pate discloses an apparatus and method for forming simulated old brick wherein the bricks are disposed on a conveyor for movement in a direction transverse to their length below a plurality of rollers. Each roller has a shaped roller surface for forming the edge of the brick to provide a simulated used brick appearance. The rollers are arranged both longitudinally and transversely on a support frame such that the entirety of the edge of each brick when moved below the rollers in a direction transverse to the axis of the rollers will be contacted by the rollers and formed to the desired configuration. U.S. Pat. No. 275,888 to Coutant also discloses a multiplicity of roller faces mounted on a single axis for simultaneously treating a plurality of spaced bricks in a single row. Other apparatus and methods for forming simulated old brick are dependent upon rotary or reel-type wire cutting devices to form the brick to the desired configuration. These known methods, however, require skilled labor to maintain adjustments, repairs and supplies and there has consequently arisen a need for more efficient apparatus and methods for forming simulated old brick which requires a minimum of skilled labor and is of a construction having relatively few mechanically moving parts and minimal need for adjustment.

Accordingly, it is a primary object of the present invention to provide novel and improved apparatus for forming simulated old brick.

It is another object of the present invention to provide novel and improved apparatus for forming simulated old brick wherein only a minimum of manual labor is required.

It is still another object of the present invention to provide novel and improved apparatus for forming simulated old brick wherein the edges of a lengthwise extending face of each new brick are rounded and textured to simulate old brick.

It is a further object of the present invention to provide novel and improved apparatus for forming simulated old brick wherein the apparatus is inexpensive to construct and is readily and easily utilized.

It is a related object of the present invention to provide novel and improved apparatus for forming simulated old brick having the capacity to mass produce such simulated old brick.

Additional objects and advantages of the invention will be set forth in part in the description which follows, and in part will be obvious from the description, or may be learned by practise of the invention. The objects and advantages of the invention may be realized and attained by means of the instrumentalities and combinations particularly pointed out in the appended claims.

To achieve the foregoing objects and in accordance with the purposes of the invention, as embodied and broadly described herein, an apparatus according to this invention comprises a support for a plurality of bricks arranged in a row, means carried by the support for changing the relative elevation of adjacent bricks in the row to locate lengthwise extending faces of alternate bricks in the row at elevations different than the elevations of the corresponding lengthwise extending faces of the bricks adjacent the alternate bricks in the row, and means carried by the apparatus for forming an impression in the lengthwise extending faces of the alternate bricks.

Preferably, the means for changing the relative elevation of adjacent bricks include a first set of ramps transversely spaced one from the other a distance substantially equal to or in excess of the width of a single brick whereby the lengthwise extending faces of alternate bricks are projected out of a plane containing the lengthwise extending faces of the non-elevated bricks upon movement of the bricks longitudinally along the support past the ramps. A plurality of transversely spaced rollers are disposed in registration above the ramps and are engaged by the alternate bricks when elevated relative to the non-elevated alternate bricks remaining on the support. Each roller preferably has a cylindrical face and a pair of flanges. A die or impression of rough and irregular formation is formed at the junction of the face and each flange to form textured and rounded edges along the opposite sides of the elevated lengthwise extending face of each alternate bricks.

A second similar set of transversely spaced ramps are also disposed at a location along the support longitudinally spaced from the first set of ramps. The first and second sets of ramps are transversely offset or staggered relative to one another. Consequently, alternate bricks, unedged by the cooperation of the first set of ramps and rollers, are elevated by the second set of ramps into engagement with similar rollers whereby the edges of these bricks are likewise rounded and textured to form simulated old brick.

The invention further consists in the novel parts, constructions and arrangements, combinations and improvements shown and described in connection with the accompanying drawings which illustrate one embodiment of the invention and, together with the description serve to explain the principles of the invention.

IN THE DRAWINGS

FIG. 4 is a vertical longitudinal cross-sectional view through a portion of the apparatus illustrated in FIG. 1;

FIG. 5 is a fragmentary plan view of the apparatus illustrated in FIG. 4;

FIG. 6 is a vertical endwise cross-sectional view taken generally about on line 6—6 in FIG. 4.

Reference will now be made in detail to the present preferred embodiment of the invention, an example of which is illustrated in the accompanying drawings.

Figures 1, 2, 3:
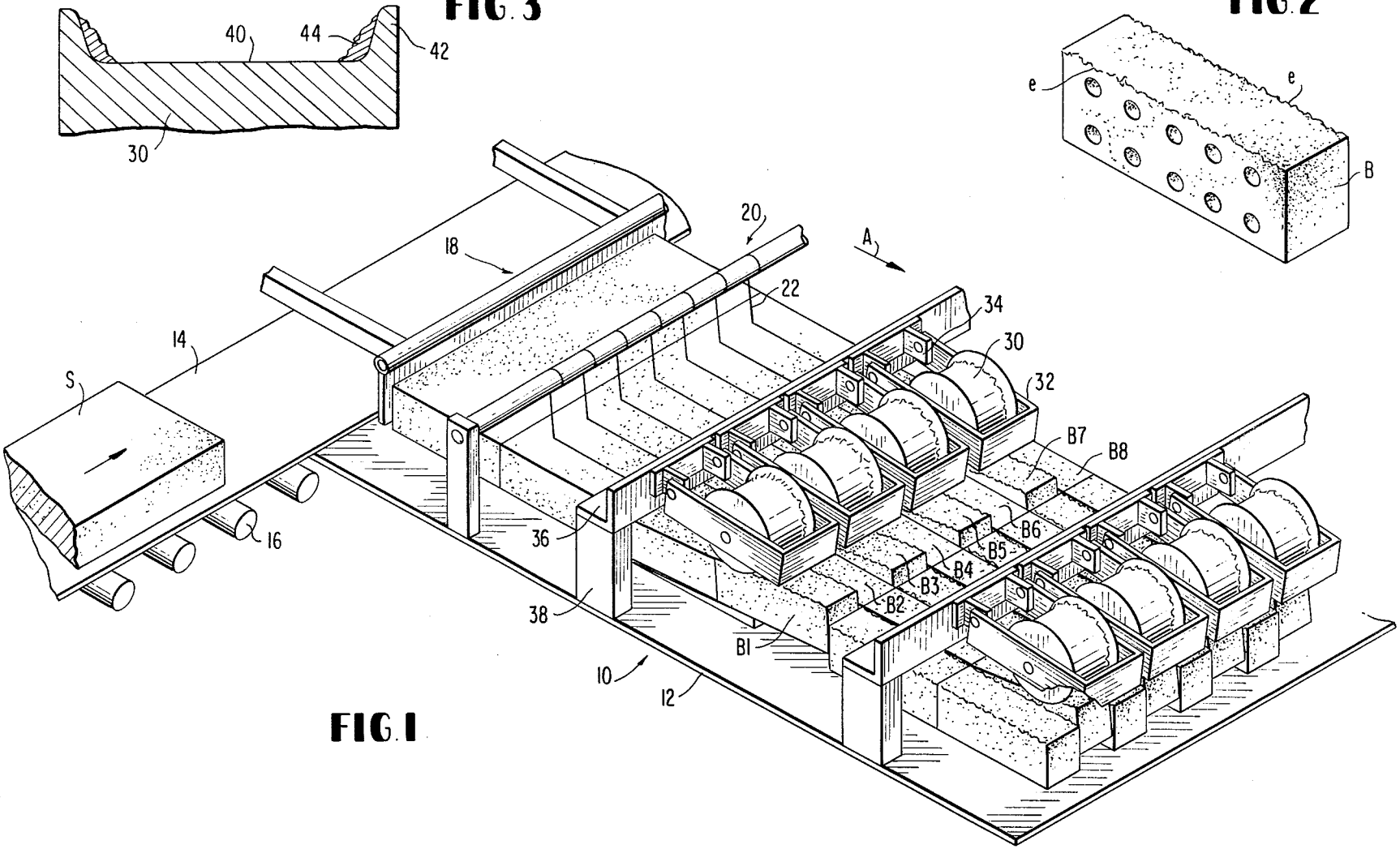
FIG. 1 is a fragmentary perspective view illustrating apparatus for forming simulated old brick constructed in accordance with the present invention.
FIG. 2 is a perspective view of a simulated old brick formed in accordance with the principles of the present invention and by the apparatus practised with the apparatus illustrated in FIG. 1.
FIG. 3 is a fragmentary enlarged cross-sectional view through one of the forming rollers.

Referring now to FIG. 1, there is illustrated an elongated support, generally designated 10, comprised of a plate 12, one end of which is disposed adjacent a transversely extending conveyor 14. Conveyor 14 is preferably of the belt type for conveying a slug S of material from which bricks are formed over rollers 16 into position for displacement in a longitudinal direction onto support 10 by means of a pusher generally designated 18. Pusher 18 is of conventional construction and is only schematically illustrated in FIG. 1. It is believed sufficient to note that pusher 18 engages the far side of slug S when slug S is conveyed into longitudinal registry with support 10 for displacing slug S onto support 10. In actual use, pusher 18, when moved to the position illustrated in FIG. 1 and after displacing slug S onto support 10, is raised, retracted and lowered to await registration of the next slug S on conveyor 14 for movement onto support 10 as described in detail hereinafter.

Support 10, at a location therealong spaced from conveyor 14, carries a wire cutter, generally designated 20. Wire cutter 20 includes a plurality of vertically disposed wires 22 transversely spaced one from the other a distance equal to one brick width to cut and form individual or discrete bricks when slugs S are displaced longitudinally along support 10 through wire cutter 20, for example, in the direction of arrow A illustrated in FIG. 1. It will be appreciated that the texture of the slug is of standard hardness, for example for the "stiff mud" process in brick making, and thus can be readily cut by wires 22 and formed as described in the ensuing description.

Referring now to FIGS. 4 and 5. It will be appreciated that, when the bricks lie on the support, their opposed lengthwise extending faces lie in spaced generally parallel planes. Means are provided for changing the relative elevation of adjacent bricks in the bricks cut from slugs S by wire cutter 20. That is, means are provided for projecting lengthwise extending faces lying in one of the planes to the side of the plane remote from the other plane. Such means include a first set of transversely spaced inclined ramps 24 and a second set of transversely spaced inclined ramps 26. The first and second sets of ramps 24 and 26 are longitudinally spaced one from the other for reasons discussed hereinafter. Ramps 24 and 26 are inclined in the direction of the longitudinal movement of the bricks along support 10, i.e., in the direction of arrow A illustrated in FIG. 1. The ramps in each set thereof are transversely spaced one from the other across support 10 a distance at least equal to and preferably slightly greater than the width of a full brick. Preferably, each ramp 24 and 26 extends longitudinally a distance in excess of the length of a full brick.

From a review of FIG. 5, it will be appreciated that the first set of ramps 24 and second set of ramps 26 are transversely staggered or offset relative to one another such that the ramps 24 are longitudinally aligned with the spaces between ramps 26. Conversely, ramps 26 are longitudinally aligned with the spaces between ramps 24. Also, for reasons which will become apparent from the ensuing description, the distance between the raised ends of ramps 24 and the leading or nearest ends of ramps 26 is preferably in excess of a complete brick length.

As described in greater detail hereafter, alternate bricks in each transverse row of bricks formed from a single slug S will be inclined and elevated by ramps 24 relative to adjacent bricks when such row of bricks is displaced longitudinally along support 10 and through the first set of ramps 24. That is, the upper lengthwise extending faces of the alternate bricks are elevated above or projected beyond the upper lengthwise extending faces of the non-elevated bricks. Once the alternate and inclined bricks are moved longitudinally past the first set of ramps 24, they drop off the elevated ends of ramps 24 such that their upper lengthwise extending faces lie in a plane generally common with the plane containing the upper lengthwise extending faces of the unelevated bricks. Alternate bricks of the same transverse row thereof will likewise, upon movement of such bricks longitudinally through the second set of ramps 26, be inclined to elevate their upper lengthwise extending faces above the plane containing the upper lengthwise extending faces of the non-elevated of bricks. It will be appreciated, however, that the alternate bricks first elevated by ramps 24 remain non-elevated when the bricks pass through the second set of ramps 26 in view of the transverse offset or staggered relation of the ramps 24 and 26. Conversely, the bricks not raised or elevated when passed through the first set of ramps 24 are elevated and inclined when passed through the second set of ramps 26. Also, when the elevated bricks are advanced past the second set of ramps 26, they similarly drop off the ends of ramps 26 and return such that their upper lengthwise extending faces lie in a plane common to the upper lengthwise extending faces of the unelevated or remaining bricks.

Disposed below support 10 is a vibrator 28. Vibrator 28 is provided to ensure that the inclined and elevated bricks from both the first and second sets of ramps are returned to the support at an elevation common to the unelevated bricks along support 10. Vibrator 28 is preferably of a rotary type, for example Model EP-46 manufactured by Vibro-Plus Products.

Also carried by support 10 in vertical registration with each of the first and second sets of ramps 24 and 26 is a set of rollers for rounding and texturing the longitudinally extending edges of the inclined, lengthwise extending, faces of the bricks. Since each set of rollers is identical to the other set except in their relative location as noted below, a description of one set of rollers will suffice as a description of the other set of rollers. More particularly, each set of rollers includes a plurality of transversely spaced rollers 30 carried for rotation about transverse axes by a plurality of yokes 32. Yokes 32 are pivoted at their ends to support plates 34 carried by a transversely extending bar 36 supported above the bricks on support 10 by stanchions 38 located on opposite sides of support 10. Rollers 30 are transversely spaced one from the other similarly as the underlying ramps 24 and 26, respectively. That is, each roller 30 lies in vertical registration above a corresponding ramp and at a longitudinal location adjacent the high end of the ramp.

Referring to FIG. 3, each roller includes a smooth cylindrical peripheral face 40 with axially spaced flanges 42, the roller being preferably formed of steel. The juncture of each flange 42 and face 40 is provided with a die or an impression 44 which extends about the entire periphery of roller 30. These impressions are molded onto the flanges and face and are provided with a rough and irregular surface to form the desired textured and rounded edges in the bricks. The impressions or dies 44 therefore constitute molds which form complementary surfaces in the edges of the brick upon engagement of the brick with the roller as described hereinafter. Rollers 30 are preferably weighted and normally hang vertically of their own weight in position for engagement by the leading edge of a brick inclined along the corresponding registering and underlying ramp.

It will be appreciated that rollers 30 can be formed of materials other than steel, for example plastic. Also, it will be appreciated that the rollers need not be weighted but can be biased to engage the bricks moving along the ramps by tensioning devices, for example springs. However, it has been found that such tensioning devices can be eliminated simply by using weighted rollers. Further, impressions 44 formed along the edges of rollers 30 can be hand formed from synthetic steel but may, of course, be otherwise formed.

For the purposes of the following description of a method of utilizing the apparatus previously described to form simulated old bricks, successive slugs disposed on elongated support plate 10 are labelled "S1", "S2", "S3" . . . etc. Further, the alternate bricks edged or formed by the first set of rollers 30 in registry with the first set of ramps 24 are called out as odd numbered bricks B1, B3, B5, B7 . . . etc. while the bricks which are edged or formed by the second set of rollers in vertical registry with the second set of ramps 26 are called out as even numbered bricks B2, B4, B6, B8 . . . , etc.

Figures 7A, 7B, 7C, 7D, 7E, 7F, 7G, 7H, 7I, 7J:
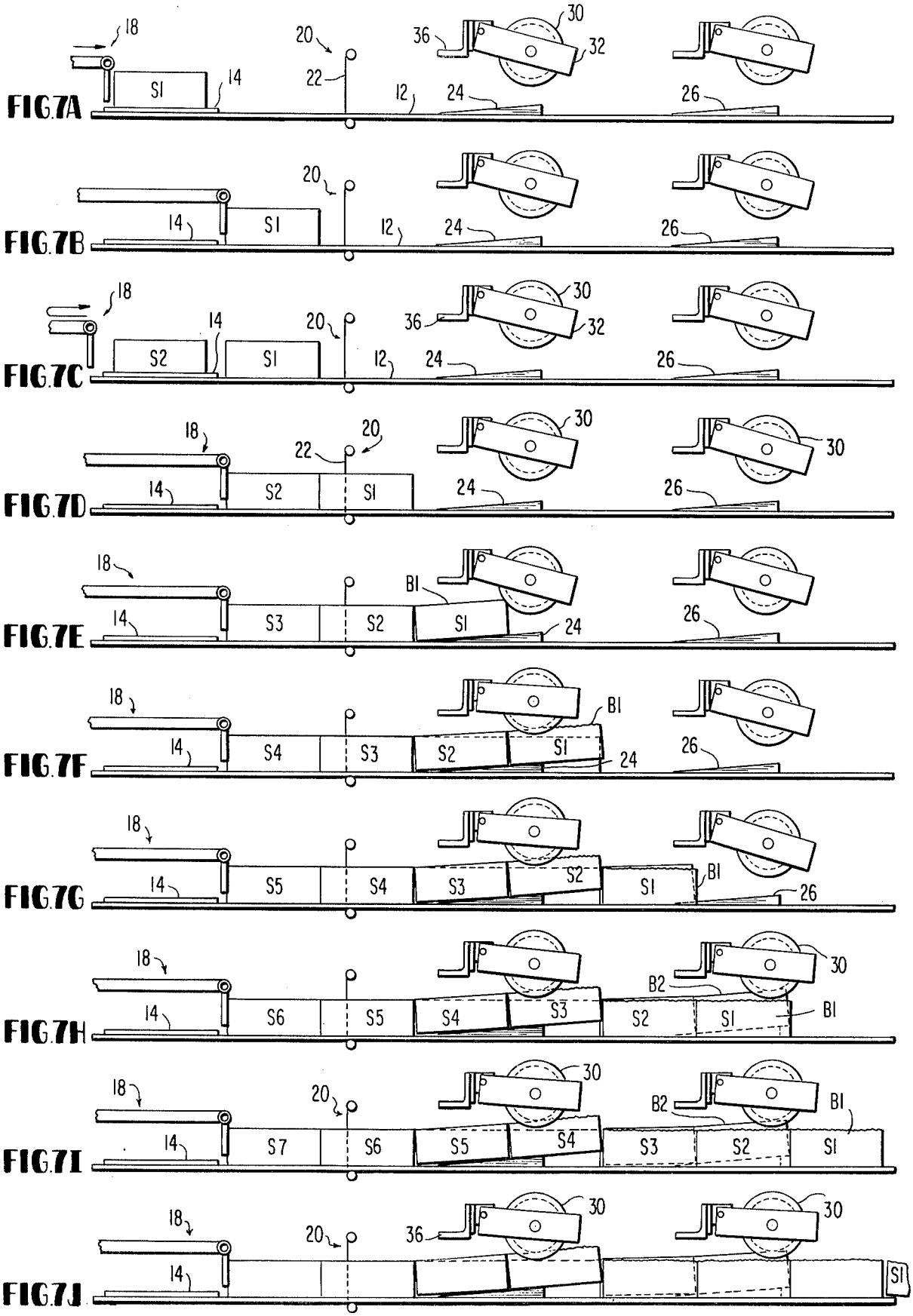
FIGS. 7A–7J are fragmentary side elevational views which schematically illustrate the apparatus for and method of forming simulated old brick in accordance with the present invention.

Referring now to FIG. 7A, a first slug S1 disposed on conveyor 14, lies in alignment with longitudinally extending support plate 12. Slug S1 is then displaced by pusher 18 from conveyor 14 onto plate 12 as illustrated in FIG. 7B. In FIG. 7C, a second slug S2 is located in longitudinal alignment with plate 12 behind first slug S1 on plate 12 and pusher 18 is poised to displace slug S2 from conveyor 14 onto support plate 12. Pusher 18 then advances slug S2 from conveyor 14 onto support plate 12. In displacing slug S2 from the conveyor, slug S2 engages slug S1 and both slugs are advanced jointly along support plate 12. Slug S1 is also advanced along support plate 12 partially through wire cutter 20. As the next slug S3 is indexed from conveyor 14 onto support plate 12, discrete bricks B are formed from slug S1 and the odd numbered bricks of slug S1, for example bricks B1, B3, B5, B7 illustrated in FIG. 1, are moved along ramps 24 while the even numbered bricks of slug S1, i.e. bricks B2, B4, B6, B8, etc. pass between ramps 24, remain unelevated, and continue to lie in a common plane parallel to and along support plate 10.

It will be appreciated, from a review of FIG. 7E, that, upon advancing slug S3, the leading edge of the inclined odd numbered bricks B1 . . . , etc. of slug S1 engage the surface of rollers 30. When the next slug S4 is displaced onto support plate 12 and indexes slugs S1, S2 and S3 forwardly, the odd numbered bricks B1 . . . , etc. of slug S1 are advanced under rollers 30. During such advancement, impressions 44 on rollers 30 form impressions along the inclined lengthwise extending faces of the elevated bricks, and particularly form textured and rounded surfaces along their longitudinally extending edges to simulate old brick. As the next slug S5 is indexed onto support plate 12, the bricks of slug S1 are advanced beyond ramps 24 and the odd numbered bricks B1 . . . , etc., drop from ramps 24 back into the plane common to the bricks remaining on support plate 12. Vibrator 28 vibrates plate 12 to ensure that the odd numbered bricks elevated or inclined by ramps 24 overcome the frictional resistance of their contact with adjacent unelevated bricks and drop back onto plate 12 flush with the unelevated bricks. Consequently, as illustrated in FIG. 7G, the odd numbered bricks B1 . . . , etc., of slug S1 have been formed to simulate old brick by the rollers 30 overlying the first set of ramps 24 while the even numbered bricks B2 . . . , etc. of slug S1 remain unformed new brick.

As the next slug S6 is advanced onto support plate 12 as illustrated in FIG. 7H, the even numbered bricks B2, B4, B6, B8 . . . , etc. of slug S1 are advanced onto the second set of ramps 26 for engagement with rollers 30 in vertical registration therewith. As the next slug S7 is displaced onto support plate 12, the even numbered bricks B2 . . . , etc., of slug S1 are advanced into engagement with and below the rollers 30 and these rollers 30 round and texture the lengthwise extending edges of such bricks. It will be appreciated that the odd numbered bricks B1 . . . , etc. pass between ramps 26, remain unelevated and have opposed lengthwise extending faces which continue to lie in a common plane parallel to and along support plate 10. Upon displacement of the next slug S7 onto support plate 10, the even numbered bricks B2 . . . , etc., drop from ramps 26 into positions flush with the unelevated bricks along support plate 12 with the vibrator 28 assisting the bricks to obtain the previous common elevation as previously described.

A simulated old brick B formed in accordance with the present invention and utilizing the apparatus and methods previously described is illustrated in FIG. 3. As illustrated, the lengthwise extending edges e along the upper face of the brick illustrated are rounded and textured on an irregular pattern complementary to the pattern provided in impression 44. While not shown and not a part of this invention, the end face of the brick B can likewise be rounded and textured by a roller having a similar die as impressions 44 and located adjacent conveyor 14, the roller bearing along the forward faces of the slugs as they are advanced along conveyor 14. It will be appreciated that the simulated old brick is thereafter formed continuously and that FIG. 7J illustrates the bricks at their various positions along the apparatus during continuous formation of the simulated old brick.

It will also be appreciated that the elevation of the even and odd numbered bricks at different longitudinal locations respectively along support 12 enables the flanges 42 of rollers 30 to drop below the elevated face of the inclined bricks without contact with adjacent bricks. This brings the impressions on the rollers into contact with the edges of the elevated bricks to enable impressions 44 to round and texture the edges. Also, the elevation imparted to the bricks by the ramps is maintained substantially less than one full brick height. This enables the bricks to be advanced through each set of ramps and rollers by the pusher 18 rather than necessitating independent means for advancing the elevated brick. Furthermore, since the rollers normally hang in the path of movement of the elevated brick and are weighted, there is no need to provide mechanisms for mechanically biasing the rollers into engagement with the bricks, there being sufficient force available from the weight of the roller for the die 44 to form the rounded and textured edges in the face of the brick. Also, the vibration imparted to the support and the ramps enables the bricks to return to their initial elevation.

It will be further appreciated that while two sets of ramps and rollers longitudinally spaced one from the other are described and illustrated herein whereby alternate bricks in each transverse row thereof are inclined and formed, the apparatus and process of the present invention can be employed with different transverse spacing of the rollers and corresponding registering ramps whereby such ramps and rollers may act upon every third, fourth or fifth brick as desired with a like number of longitudinal locations of such rollers and ramps along the apparatus. While only four ramps and four corresponding rollers are described and illustrated herein at each longitudinal location along support 10, the number of ramps and rollers at each longitudinal location can be increased or decreased as desired or in accordance with the number of simulated old bricks desired to be manufactured for each indexing along the support 10. Furthermore, it will be appreciated that the bricks can be changed in elevation in the opposite direction. That is, declining ramps with openings in the support plate for receiving portions of rollers located on the underside of the support plate can be used such that the lower edges of the bricks can likewise be formed by the roller.

In a specific preferred embodiment of the present invention, the ramps are two inches in width and are spaced transversely one from the other two and three-quarters inches apart whereby the ramps are slightly narrower than the width of the brick and the space between the ramps is slightly greater than the width of a brick. Each ramp preferably inclines for approximately $\frac{3}{4}$ inch for a length of $9\frac{1}{2}$ inches whereby the angle of inclination is 4.5°. Approximately $11\frac{1}{2}$ inches are provided between the end face of the first set of ramps 24 and the leading edge of the second set of ramps 26 whereby such spacing is in excess of a length of brick to enable the previously inclined bricks to drop into positions at a common elevation flush with the previously unelevated bricks. The rollers 30 are preferably $5\frac{3}{4}$ inches in diameter with the flat surfaces having a diameter of $4\frac{7}{8}$ inches. The rollers also have a width of $2\frac{3}{4}$ inches with the flat surface being 2 inches wide thus assuring that the standard brick $2\frac{3}{8}$ inches wide will be forming by the impressions 44 provided between the flanges and the smooth cylindrical surface of the roller.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. Apparatus for forming simulated old brick comprising:

a support for a plurality of bricks arranged in a row;

means for changing the relative elevation of adjacent bricks in said row to locate lengthwise extending faces of alternate bricks in said row at elevations different than the elevations of the corresponding lengthwise extending faces of bricks adjacent the alternate bricks in said row; and means for forming impressions in the lengthwise extending faces and edges of said alternate bricks.

2. Apparatus according to claim 1 wherein the bricks initially lie on said support such that opposed lengthwise extending faces thereof lie in spaced generally parallel planes, said changing means including means for projecting the lengthwise extending faces of said alternate bricks lying in one of said planes to the side thereof remote from the other of said planes, said forming means being disposed on the remote side of said one plane for engagement with each projected lengthwise extending face of said alternate bricks.

3. Apparatus according to claim 2 wherein said forming means includes a plurality of rollers transversely spaced one from the other for engagement with the projected lengthwise extending faces of the alternate bricks, at least part of the circumference of each roller having a die for forming an impression in the lengthwise extending face and edges of a brick, and means for moving said rollers and the row of bricks relative to one another in a longitudinal direction to form impressions in the lengthwise extending faces and edges of the alternate bricks.

4. Apparatus according to claim 1 wherein the bricks initially lie on said support with their opposed lengthwise extending faces lying in spaced generally parallel planes, said changing means including at a predetermined location along said support a plurality of ramps transversely spaced one from the other a distance no less than the width of a single brick, and means for moving said bricks along said support in a longitudinal direction through said predetermined location whereby alternate bricks are moved along said ramps to project the lengthwise extending faces thereof lying in one of said planes to the side of said one plane remote from the other of said planes.

5. Apparatus according to claim 4 wherein said support extends in a generally horizontal direction and said ramps project upwardly from said support whereby the upper lengthwise extending faces of said alternate bricks are projected upwardly out of said one plane to receive the impressions.

6. Apparatus according to claim 5 wherein said ramps have discrete lengths enabling the alternate bricks to drop from said ramps onto said support to locate the opposed lengthwise extending faces thereof in said parallel planes respectively after the impressions are formed in the upper longitudinally extending faces thereof.

7. Apparatus according to claim 1 wherein said support is elongate and the bricks are adapted to be arranged in a plurality of longitudinally and transversely extending rows along said support, said changing means being carried by said support at a first longitudinal location therealong, second means carried by said support at a second longitudinal location therealong for changing the relative elevation of adjacent bricks in a transversely extending row thereof at said second longitudinal location to locate lengthwise extending faces of alternate bricks in the latter row of bricks at elevations different than the elevations of the corresponding longitudinally extending faces of bricks in the latter row of bricks adjacent the alternate bricks, means for forming impressions in the lengthwise extending faces and edges of the latter mentioned alternate bricks to simulate an appearance of old brick, means for displacing rows of bricks longitudinally through said first and second locations, said first and second changing means being disposed such that said second changing means changes the elevation of bricks not previously changed in elevation at said first changing means.

8. Apparatus according to claim 7 wherein the longitudinal and transverse rows of bricks initially lie on said support with their opposed lengthwise extending faces lying in spaced generally parallel planes, said first and second changing means including means for projecting the lengthwise extending faces of the transversely adjacent bricks lying in one of said planes to the side thereof remote from the other of said planes, the first mentioned forming means and the second mentioned forming means being disposed on the remote side of said one plane for engagement with each projected lengthwise extending face and edges of the alternate bricks.

9. Apparatus according to claim 8 wherein said first and second forming means includes first and second longitudinally spaced rows of transversely spaced rollers for engagement with the lengthwise extending faces and edges of the respective alternate bricks, at least part of the circumference of each roller having a die for forming an impression in the lengthwise extending face and edges of a brick, and means for moving said rollers and the transverse rows of bricks relative to one another in a longitudinal direction to form impressions in the lengthwise extending faces and edges of the alternate bricks at said first and second longitudinal locations.

10. Apparatus according to claim 7 wherein the longitudinal and transverse rows of bricks initially lie on said support with their opposed lengthwise extending faces lying in spaced generally parallel planes, said first and second changing means including at each of said first and second longitudinal locations along said support a plurality of ramps transversely spaced one from the other a distance no less than the width of a single brick, whereby the lengthwise extending faces of the alternate bricks lying in one of said planes are projected to the side thereof remote from the other of said planes upon movement of the rows of bricks longitudinally along said support.

11. Apparatus according to claim 1 wherein the bricks initially lie on said support such that opposed lengthwise extending faces thereof lie in spaced generally parallel planes, said changing means including means for projecting lengthwise extending faces of the alternate bricks lying in one of said planes to the side thereof remote from the other of said planes, and means for altering the elevation of said alternate bricks to return said alternate bricks such that opposed lengthwise extending faces thereof lie in said planes respectively after the impressions are formed in their faces.

12. Apparatus according to claim 6 including means for vibrating said support to enable the alternate bricks to lie with their opposed lengthwise extending faces respectively in said planes.

13. Apparatus for forming simulated old brick comprising an elongated support for a plurality of bricks arranged in a transversely extending row;

means carried by said support at a predetermined longitudinal location therealong for elevating selected bricks in said row thereof including a plurality of ramps transversely spaced one from the other a distance no less than the width of a single brick, means for moving the bricks along said support in a longitudinal direction and through said predetermined location to move the selected bricks along said ramps and thereby elevate the selected bricks, and means in registration above said ramps for forming impressions in the uppermost lengthwise extending faces of the elevated bricks to form simulated old brick.

14. Apparatus according to claim 13 wherein said forming means includes a plurality of rollers transversely spaced one from the other in vertical registration above said ramps for engaging the lengthwise extending faces of the selected elevated bricks.

15. Apparatus according to claim 14 wherein each of said rollers has a pair of axially spaced flanges and a cylindrical surface intermediate said flanges, a die formed about each roller adjacent the juncture of each flange and said cylindrical surface for texturing the opposite edges of the lengthwise extending face of the selected elevated bricks.

16. Apparatus according to claim 13 wherein the bricks initially lie on said support such that opposed lengthwise extending faces thereof lie in spaced generally parallel planes, said ramps having discrete lengths enabling the selected bricks to drop from said ramps onto said support and lie with said faces respectively in said planes when the bricks are moved past said predetermined location.

17. Apparatus according to claim 16 including means for vibrating said support to ensure that the selected bricks, when dropped from said ramps, lie with their opposed lengthwise extending faces respectively in said planes.

18. Apparatus according to claim 13 wherein said ramps comprise a first set of ramps at a first predetermined location along said support, means carried by said support at a second predetermined location therealong spaced longitudinally from said first predetermined location for elevating selected bricks in said row thereof including a second set of ramps transversely spaced one from the other a distance no less than the width of a single brick, said moving means moving the bricks along said support through said second predetermined location, the ramps of said first and second sets of ramps being transversely offset one from the other such that different selected bricks are elevated by said second set of ramps than by said first set of ramps, and means in registration above said second set of ramps forming impressions in the uppermost lengthwise extending faces of the selected bricks elevated by said second set of ramps to form simulated old brick.

19. Apparatus according to claim 18 wherein each of the forming means in respective registration above the first and second sets of ramps includes a plurality of rollers transversely spaced one from the other in vertical registration above the associated ramps for engaging the lengthwise extending faces of the selected elevated bricks.

20. Apparatus according to claim 19 wherein each of said rollers has a pair of axially spaced flanges and a cylindrical surface intermediate said flanges, a die formed about each roller adjacent the juncture of each flange and said cylindrical surface for texturing the opposite edges of the lengthwise extending face of the selected elevated bricks.

21. Apparatus according to claim 18 wherein the bricks initially lie on said support such that opposed lengthwise extending faces thereof lie in spaced generally parallel planes, said ramps having discrete lengths enabling the selected bricks to drop from said ramps onto said support and lie with said faces respectively in said planes when the bricks are moved past said first and second locations.

22. Apparatus according to claim 21 including means for vibrating said support to ensure that the selected bricks, when dropped from said ramps, return to said common plane.

23. Apparatus according to claim 18 wherein said first and second sets of ramps are longitudinally spaced one from the other a distance in excess of the length of a single brick.

* * * * *